United States Patent [19]

Morris et al.

[11] 3,983,582

[45] Oct. 5, 1976

[54] INTEGRAL CONTOURED SEAT AND FLUSHING RIM FOR TOILET BOWLS AND METHOD FOR MAKING SAME

[75] Inventors: Earl L. Morris; Theodore J. Sally, both of Whittier, Calif.

[73] Assignee: Acorn Engineering Company, City of Industry, Calif.

[22] Filed: July 5, 1972

[21] Appl. No.: 269,180

[52] U.S. Cl. ..... 4/98; 4/237

[51] Int. Cl.[2] ..... A47K 13/00

[58] Field of Search ..... 4/98, 89, 13, 10, 9

[56] References Cited

UNITED STATES PATENTS

| | | | |
|---|---|---|---|
| 268,740 | 12/1882 | Smith | 4/98 X |
| 522,010 | 6/1894 | Greene | 4/98 X |
| 2,817,092 | 12/1957 | Hahn | 4/89 X |
| 2,847,681 | 8/1958 | Jacobs | 4/89 X |

*Primary Examiner*—Stanley N. Gilreath
*Assistant Examiner*—Robert Pous
*Attorney, Agent, or Firm*—Ben E. Lofstedt

[57] ABSTRACT

An improved toilet seat and flushing rim joined as an integral part of the toilet bowl, comprising a hollow, disc-shaped annulus with an egg-shaped perforation therein for the passage of human excrement and having an upper wall sloping downwardly from its outer rim and inwardly towards its inner rim which surrounds the perforation forming a toilet seat and a lower wall joined in fluid sealing relationship to the inner rim of the upper wall and sloping downwardly therefrom and outwardly towards the toilet bowl sidewall and having a serrated edge about its outer peripheral edge the edge being disposed in juxtaposition to the inside sidewall of the toilet bowl, thereby forming an inherently selfdraining flushing rim.

6 Claims, 3 Drawing Figures

INTEGRAL CONTOURED SEAT AND FLUSHING RIM FOR TOILET BOWLS AND METHOD FOR MAKING SAME

BACKGROUND OF THE INVENTION

1. FIELD OF THE INVENTION

The present invention lies within the fields of integral contoured toilet seats and flushing rim combinations.

2. DESCRIPTION OF THE PRIOR ART

In the process of depositing human excrement in a toilet bowl and/or immediately thereafter, portions of either or both the liquid and solid fecal matter may be deposited on the inner sidewall of the toilet bowl.

When such deposits are above the stationary water level in the toilet bowl, noxious, foul-smelling odors are produced by the combined effects of the bacterial activity typically found in human excrement and by the continuing decomposition activity of the fecal and ureic mixtures and combinations.

To prevent the accumulation of undesirable odors, it is necessary to remove the odor-causing excrement from the sidewall of the toilet bowl. Most often this is accomplished by mechanically scraping the sidewall clean of such deposited matter with a toilet brush or the like. However, in penal institutions and other similaer public institutions, this is not conveniently possible and is, in fact, highly undesirable since such brushes can oftentimes be modified into man-endangering weapons should they fall into the hands of the inmates of such institutions.

The use of chemical substances and abrasive substances such as cleansers generally must be utilized in combination with a brush, or similar scrubbing device, to be reasonably effective. In addition, many chemical and abrasive substances are mildly or strongly toxic to humans when inhaled or eaten, and therefore, are rarely, if ever, desirable or acceptable for this purpose when used by the inmate himself.

To permit frequent custodial maintenance by a non-inmate is inconvenient, costly and increases the probability, as well as the possibility, of a breach of penal, or institutional, security.

A unique and novel solution to the problem of preventing or/and removing the accumulation of odor-causing substances from the sidewall of the toilet bowl is to provide a means for periodically washing the above-the-water or unsubmerged surface of the sidewall by means of a relatively high velocity concentrated sheet or stream of water. Such may be accomplished by means of an integral toilet seat and flushing rim combination. When the toilet is flushed the forceful action of the high-velocity water clears the sidewall of odor-producing substances.

Numerous attempts have been made to develop an integral toilet seat and flushing rim combination which is capable of fully washing all areas of the toilet bowl sidewall disposed above the normal, standing water level in the toilet bowl. Much of this activity has centered around toilets which are constructed from eye-appealing and long-lasting stainless steel, rather than easily damaged ceramic materials. For the most part, ceramic toilet fixtures are inadequate for the durable service required for penal institutions.

All previous attempts to develop a toilet seat and flushing rim combination have resulted in an unacceptable product for one or more of the following reasons:

First of all, all previous seat-rim combinations possessed flat seat tops and were not contoured for user comfort and ease of elimination.

Secondly, at least one seat-rim combination employed a number of small perforations annularly rimming the underside of the seat-rim to serve as exit ports for the water used for flushing. The perforations were also disposed away from the sidewall of the toilet bowl on the flat surface of the underside of the seat-rim. When the toilet was flushed, the water would enter the hollow, annular seat-rim and subsequently exit through the perforations on the underside of the seat-rim. Due to the fact that the perforations were both disposed away from the wall and resided on a flat surface, the flushing water failed to wash and clean a significant portion of of the toilet bowl sidewall immediately adjacent to the point at which the underside of the seat-rim joined or merged with the substantially vertical sidewall.

One reason for disposing the small perforations away from the toilet bowl sidewall was to prevent them from being plugged during the brazing or welding process. Typically the outer edge of the annular rim of the underside portion of the seat-rim was joined to the toilet bowl sidewall by either welding or brazing. If the small perforations were drilled or punched too closely to the seat-rim edge which was brazed or welded to the sidewall, plugging or blocking of many or all of the perforations would occur.

Consequently, a compromise was effected by moving the small perforations away from the outer edge of the annular rim of the underside portion of the seat-rim.

Thirdly, one attempt to solve the combined problems of plugging or blocking the perforations and of failing to completely wash all sidewall areas, involved the locating of the perforations substantially in the middle of an upwardly-curving radius circumferencially disposed and formed along the outer annular portion of the underside of the seat-rim. The outer edge of the radiused portion was brazed or welded or otherwise joined to the sidewall of the toilet bowl for support.

By locating the perforations on the radius, a substantially greater portion of the sidewall is washed as the exiting water is directed outwardly in a radial fashion towards the sidewall and not merely vertically downward during the flushing cycle.

However, this solution was also, nevertheless, unacceptable because a V-like groove was effectively formed immediately beneath the point at which the seat-rim edge is welded or brazed to the toilet bowl sidewall creating an area wherein fouling can occur and thereby cause or produce odors, because this area was not washed during the flushing process.

Fourthly, another problem encountered in prior seat-rim combinations involved the retention of an amount of flushing water within the hollow flushing rim. Such water can also become foul and noxious-smelling and serve as a repository for undesirable bacterial growth.

SUMMARY OF THE INVENTION AND OBJECTS

The present invention comprises a novel and unique integral contoured toilet seat and flushing rim. It is primarily useful when used in the construction of non-ceramic toilet bowls, such as a stainless steel bowl.

When the toilet is flushed the water enters into the hollow seat-flushing rim from the side opposite the front of the seat-rim and fills both sides of the rim. At the same time, water is forced through the openings between the sidewall and the serrated edge of the bottom portion of the seat-rim.

Another object of the invention is to ensure that all toilet bowl sidewall area are washed during flushing to prevent fouling and to eliminate the subsequent noxious odors associated therewith.

A still further object of the invention is to prevent water from being retained in the hollow chamber between flushing cycles.

These and other objects will be apparent from the following description of an illustrative embodiment shown in the appended drawings wherein:

DESCRIPTION OF THE PREFERRED EMBODIMENT

With continued reference to the drawings, a toilet bowl 10 is shown with the toilet seat and rim combination 11, installed as an integral unit of the toilet bowl 10.

Figure 1:
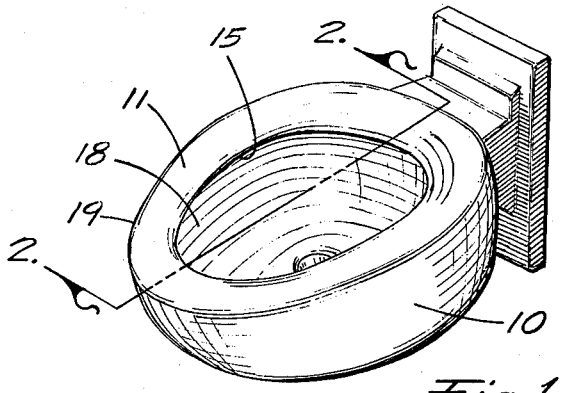
FIG. 1 is an isometric view of the integral seat-flushing rim shown installed in a wall-hung toilet bowl.
Figure 2:
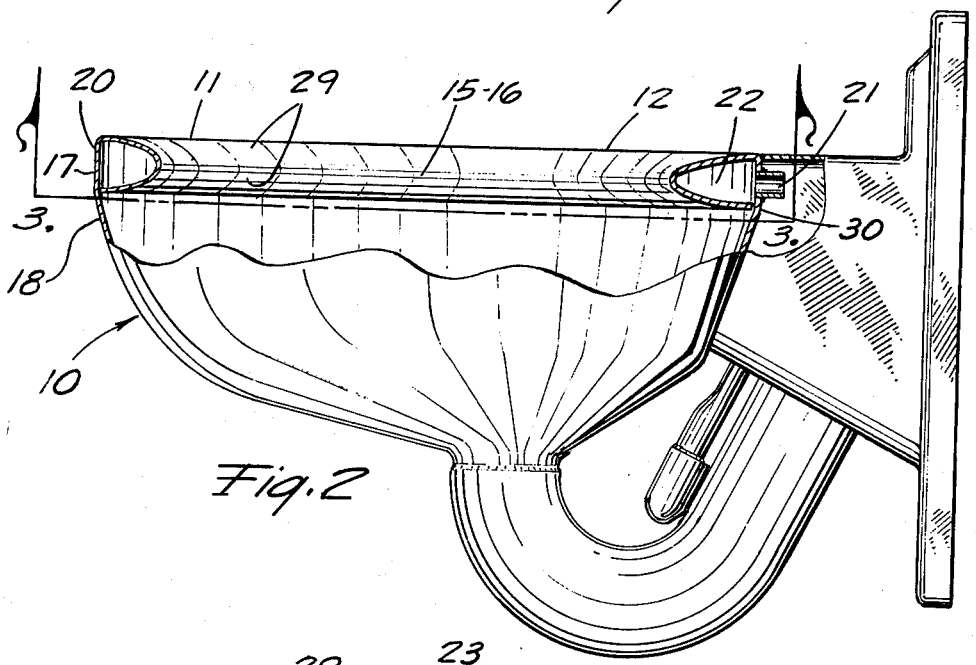
FIG. 2 is a side elevational view of the wall-hung toilet bowl and seat-rim combination taken along 2—2 of FIG. 1 showing the hollow cross-section of the seat-rim and the contour of the seat.

Referring now to FIG. 2, a fragmentary cutaway section is shown revealing the cross-sectional-area of the toilet seat and rim combination 11. Said seat and rim combination 11 is composed of a contoured toilet seat 12 and a rim 13. As shown, the seat 12 is contoured by sloping the egg-shaped, annular portion thereof which forms the seat 12, downwardly towards the bottom of the toilet bowl 10 and radially inward towards the center thereof. Such contouring of the seat 12 provides a comfortable seat 12 for the user and increases the structural strength of the seat and rim combination 11.

The annular rim 13 is identical to the annular rim which forms the seat 12 except for the serrated outer circumferencial edge 14 and to form the combination 11 is inverted so that the contour 29 rises upwardly in a radial fashion towards the center of the rim 13. The seat 12 and the rim 13 are aligned so that the inner edges 15, 16 of the seat 12 and the rim 13 contact each other. Once aligned, these edges 15, 16 are welded or brazed together thereby forming a unitary seat and rim combination 11.

As further shown in FIG. 2, the upper portion 17 of the side-wall 18 is essentially vertical throughout a distance which is at least equal to that of the maximum thickness of the cross-sectional portion of the seat and rim 11.

The seat and rim 11 is then slideably inserted into the upper vertical portion 17 of the sidewall 18 of the toilet bowl 10 until the serrated edge 14 contacts the inwardly projecting annular surface 30 of the toilet bowl 10. The annular surface 30 provides support for the seat-rim combination 11. Following this, the outer edge 19 is brazed or welded to the rim 20 of the toilet bowl 10 for additional support, thereby forming an integral unit with the toilet bowl 10.

Figure 3:
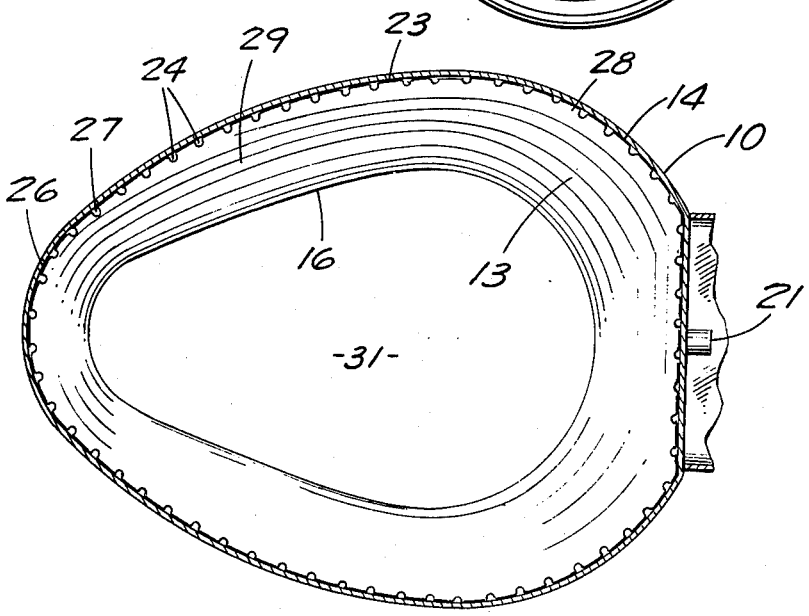
FIG. 3 is the bottom or underside view taken along 3—3 of FIG. 2 of the flushing rim showing the serrated outer edge.

As detailed in FIGS. 2 and 3, when the toilet is flushed, water enters the tubular water entry duct 21 and flows into the hollow annular chamber 22 which is formed by the seat and rim 11 in conjunction with the vertical section of the upper portion 17 of the toilet bowl sidewall 18. As the water enters the hollow chamber 22, it fills both sides of the seat-rim 11 in a substantially uniform manner. Simultaneously, the water within the chamber 22, due to the combined effects of both gravity and water pressure, is forced into the toilet bowl 10 beneath the rim 13 via the water exit passageways 24 consisting of both the notched portions 27 of the serrated outer edge 14 of the rim 13 and the gaps 26 formed between the sidewall 18 and the unnotched portions 28 of the serrated outer edge 14. The aggregate effect of the water passageways 24 is such that it creates a combination sheet and stream of relatively high velocity water which covers and completely washes all areas of the sidewall 18. As a result, since all sidewall 18 areas are washed during the flushing cycle, no fouling or any odor-producing matter can accumulate beyond the next flushing cycle.

In addition, since the outer serrated edge 14 of the rim 13 is not brazed or welded to the sidewall 18, no crevices or open voids are formed which are not subject to washing. This is due to the fact under typical manufacturing tolerances that the unnotched portion 28 of the serrated edge 14 is either placed in a tight, abutting relationship to the upper vertical portion 17 of the sidewall 18 thereby forming no open cavity or crevice wherein fouling can occur, or forms a gap 26 which is washed by the water during the flushing cycle. Consequently, no fouling area is established wherein odor-causing substances can be concealed and retained thereby producing noxious or foul-smelling odors.

It should be further noted that due to the contour of the rim 13, the hollow chamber 22 is self-draining and no water is retained in the hollow chamber 22 between flushings. This, of course, prevents water stagnation from occuring which can often become a source of undesirable odors through bacterial culture formation, mildew and the like.

Such a seat and rim 11 is constructed by shearing two appropriately-sized sections of sheet materials from larger sheet blanks. The sheet sections are subsequently blanked to form therein, in each sheet, an egg-shaped perforation 31 suitably large to serve as an opening for a toilet seat for adult human buttocks and a slightly flared, contoured surface 29 which is circumferentially disposed around said perforation 31.

One of the two previously perforated and contoured sheet sections is then sheared around the perforation 31 to form an outer peripheral edge 19 which overlaps the toilet bowl rim 20 by the thickness of said rim 20, thereby forming the seat rim 12.

At least a single row of small diameter holes are punched out around the perforation 31 of the other perforated and contoured sheet section, the locus of whose centers form a pattern which is identical to the pattern of the toilet bowl rim 20 less the thickness of said rim 20, thereby forming the underside portion of the seat and rim combination 11, rim 13.

Following this step, said rims 12, 13 are aligned so that the inner edges 15, 16 of the annular rims 12, 13 respectively, are placed in an abutting relationship with each other. The abutted inner edges 15, 16 are then welded or brazed to form a single, unitary seat and rim combination 11. After joining, the joined area around edges 15, 16 is cleaned and polished on at least the outer or exposed surface to create a smooth surface, both for the sake of appearance and to eliminate any open voids or crevices which might either be hazardous to human buttocks or create a fouling area.

The unitary seat and rim 11 is then slideably inserted into the upper portion of the toilet bowl 10, which subsequently contacts the inwardly projecting annular surface 30 of the toilet bowl 10 at the outer serrated edge 14 of the rim 13, said surface 30 serving as a means of support for said seat and rim combination 11.

Next, the outer edge 19 is brazed or welded to the rim 20 of the toilet bowl 10 for support and thereby, becomes an integral unit with the toilet bowl 10.

Furthermore, it will be apparent from the foregoing that although the preferred embodiment as hereinbefore described is primarily directed towards a seat and rim constructed of metal materials, such as stainless steel, that this is not intended to in any way limit the scope of the invention thereto. Any non-metallic materials which might be suitable, such as plastics, could be easily substituted for use in the preferred embodiment, and such modification may be made without exceeding the scope of said invention.

We claim:

1. In combination:

a. a toilet bowl having an inlet for receiving human excrement into said toilet bowl and an outlet at the lower end thereof for discharging human excrement therefrom, said toilet bowl being formed by a wall which is divided into an upper wall portion having a substantially constant diameter and a lower wall portion, said upper and lower wall portions further having top and bottom portions, said top portion of said upper wall portion forming the rim of said inlet to said toilet bowl and said bottom of said upper wall portion being joined about said top portion of said lower wall portion in fluid sealing relationship therewith and said bottom portion of said lower wall portion forming the rim of said outlet to said toilet bowl, said lower wall portion extending downwardly from said top portion of said lower wall portion and inwardly towards said rim of said outlet of said toilet bowl;

b. a toilet seat and flushing rim, comprising:

a first annular disc having outer and inner rims and an aperture therein for the passage of human excrement therethrough, said disc being joined in fluid-sealing relationship about its outer rim to said rim of the opening forming said inlet to said toilet bowl and further having the top face of said disc extending downwardly away from said rim of said opening to said inlet to said toilet bowl and inwardly towards the central axis of said opening forming said inlet to said toilet bowl and forming a seat for human buttocks for said toilet bowl;

a second annular disc having inner and outer rims and an aperture therein identical to said first annular disc for the passage of human excrement therethrough, said inner rim of said second annular disc being joined in fluid sealing relationship about said inner rim of said first annular disc and having the top face of said second disc extending downwardly away from said inner rim of said first disc and towards the bottom of said upper portion of said toilet bowl thereby forming an inherently self-draining surface for water and said outer rim of said second disc having a plurality of serrations along its outer rim, said outer rim of said second disc being disposed in contiguous relationship to said wall of said toilet bowl to form a plurality of openings therebetween for the passage of water therethrough, and being further disposed immediately above and in contiguous relationship to the juncture of said bottom portion of said upper wall portion and said top portion of said lower wall portion to form a support for said toilet set and, in combination with said upper wall portion of said toilet bowl, said first and second disc forming a hollow flushing rim through which water may be directed against said wall of said toilet bowl in a continuous, undulating sheet for washing substantially the entire wall of said toilet bowl disposed therebeneath and following the cessation of the flow of water into said flushing rim, allows said flushing rim to be completely drained of said flushing water thereby eliminating sanitation problems caused by the retention of flushing water within said flushing rim; and c. water supply means communicating with said hollow flushing rim for introducing water into said toilet seat.

2. The combination of claim 1 in which said serrated edge of said outer rim of said second annular disc is disposed in abutting relationship to said toilet bowl wall.

3. The combination of claim 1 in which said serrated edge of said outer rim of said second annular disc comprises a plurality of notched sections with unnotched sections therebetween.

4. The combination of claim 1 further comprising means to support said serrated edge of said outer rim of said second annular disc about the inside wall of said toilet bowl.

5. The combination of claim 1 wherein said means to support said serrated edge of said outer rim of said second annular disc comprises an annular, inwardly-projecting shoulder formed about said wall of said toilet bowl disposed immediately beneath said serrated edge of said outer rim of said second annular disc.

6. The combination of claim 1 in which said toilet seat and flushing rim has a substantially V-shaped cross-section, the bottom of said V comprising a unitary rim formed by joining both said first and second annular discs along the inner rims of each.

* * * * *